US010351926B2

(12) United States Patent
Kuronuma et al.

(10) Patent No.: US 10,351,926 B2
(45) Date of Patent: Jul. 16, 2019

(54) HIGH TOUGHNESS AND HIGH TENSILE STRENGTH THICK STEEL PLATE WITH EXCELLENT MATERIAL HOMOGENEITY AND PRODUCTION METHOD FOR SAME

(71) Applicant: JFE STEEL CORPORATION, Chiyoda-ku, Tokyo (JP)

(72) Inventors: Yota Kuronuma, Tokyo (JP); Hirofumi Ohtsubo, Tokyo (JP); Shigeki Kitsuya, Tokyo (JP); Katsuyuki Ichimiya, Tokyo (JP); Kazukuni Hase, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 280 days.

(21) Appl. No.: 15/525,672

(22) PCT Filed: Nov. 17, 2015

(86) PCT No.: PCT/JP2015/005726

§ 371 (c)(1),
(2) Date: May 10, 2017

(87) PCT Pub. No.: WO2016/079978

PCT Pub. Date: May 26, 2016

(65) Prior Publication Data

US 2018/0155805 A1 Jun. 7, 2018

(30) Foreign Application Priority Data

Nov. 18, 2014 (JP) ..... 2014-233754

(51) Int. Cl.
*C21D 9/46* (2006.01)
*B21J 1/02* (2006.01)
(Continued)

(52) U.S. Cl.
CPC *C21D 9/46* (2013.01); *B21J 1/02* (2013.01); *B21J 5/025* (2013.01); *C21D 1/18* (2013.01);
(Continued)

(58) Field of Classification Search
None
See application file for complete search history.

(56) References Cited

U.S. PATENT DOCUMENTS

2016/0010192 A1 1/2016 Kitsuya et al.

FOREIGN PATENT DOCUMENTS

CA 2868593 A1 10/2013
CA 2899570 A1 9/2014
(Continued)

OTHER PUBLICATIONS

May 30, 2018, Office Action issued by Canadian Intellectual Property Office in the corresponding Canadian Patent Application No. 2966476.

(Continued)

*Primary Examiner* — Daniel J. Schleis
(74) *Attorney, Agent, or Firm* — Kenja IP Law PC

(57) ABSTRACT

A thick steel plate is provided by heating a continuously-cast slab, hot forging the continuously-cast slab using opposing dies having respective short sides differing such that when a short side length of a die having a shorter one of the short sides is taken to be 1, a short side length of a die having a longer one of the short sides is 1.1 to 3.0, allowing cooling to obtain a steel raw material, reheating the steel raw material, performing hot rolling of the steel raw material including at least two passes carried out, allowing cooling to obtain a thick steel plate, reheating the thick steel plate to at least the $Ac_3$ temperature and no higher than 1050° C.,
(Continued)

rapidly cooling the thick steel plate to 350° C. or lower, and tempering the thick steel plate at at least 550° C. and no higher than 700° C.

10 Claims, 2 Drawing Sheets

(51) Int. Cl.

| | |
|---|---|
| ***C22C 38/00*** | (2006.01) |
| ***C22C 38/58*** | (2006.01) |
| ***C21D 6/00*** | (2006.01) |
| ***C21D 7/13*** | (2006.01) |
| ***C21D 8/00*** | (2006.01) |
| ***C21D 8/02*** | (2006.01) |
| ***C21D 9/00*** | (2006.01) |
| ***C21D 1/18*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***B21J 5/02*** | (2006.01) |

(52) U.S. Cl.

CPC ..... *C21D 6/004* (2013.01); *C21D 6/005* (2013.01); *C21D 6/008* (2013.01); *C21D 7/13* (2013.01); *C21D 8/005* (2013.01); *C21D 8/0226* (2013.01); *C21D 8/0263* (2013.01); *C21D 9/0081* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *Y10T 428/12458* (2015.01)

(56) References Cited

FOREIGN PATENT DOCUMENTS

| | | | |
|---|---|---|---|
| CA | 2914441 | A1 | 12/2014 |
| CN | 1727512 | A | 2/2006 |
| CN | 101691640 | A | 4/2010 |
| CN | 102041458 | A | 5/2011 |
| EP | 3120941 | A1 | 1/2017 |
| JP | S55114404 | A | 9/1980 |
| JP | S61273201 | A | 12/1986 |
| JP | H06198394 | A | 7/1994 |
| JP | H06220577 | A | 8/1994 |
| JP | H1128501 | A | 2/1999 |
| JP | 2000263103 | A | 9/2000 |
| JP | 2002194431 | A | 7/2002 |
| JP | 3333619 | B2 | 10/2002 |
| JP | 2005036295 | A | 2/2005 |
| JP | 2006111918 | A | 4/2006 |
| JP | 2006263730 | A | 10/2006 |
| JP | 2010106298 | A | 5/2010 |
| WO | 2014141697 | A1 | 9/2014 |

OTHER PUBLICATIONS

Jun. 29, 2018, Office Action issued by the Korean Intellectual Property Office in the corresponding Korean Patent Application No. 10-2017-7012543 with English language concise statement of relevance.

Sep. 14, 2017, Extended European Search Report issued by the European Patent Office in the corresponding European Patent Application No. 15861988.2.

Feb. 2, 2016, International Search Report issued in the International Patent Application No. PCT/JP2015/005726.

Naoki Okumura et al., "Effect of Hot Rolling Conditions on Annihilation of Porosities in Continuous Casting Slabs", Transactions of the Iron and Steel Institute of Japan, vol. 66 (1980), No. 2, pp. 201-210.

Oct. 17, 2018, Communication pursuant to Article 94(3) EPC issued by the European Patent Office in the corresponding European Patent Application No. 15861988.2.

HIGH TOUGHNESS AND HIGH TENSILE STRENGTH THICK STEEL PLATE WITH EXCELLENT MATERIAL HOMOGENEITY AND PRODUCTION METHOD FOR SAME

TECHNICAL FIELD

This disclosure relates to a thick steel plate with excellent strength, elongation, and toughness, and excellent material homogeneity in a plate thickness direction, that is suitable for use in steel structures such as buildings, bridges, ships, marine structures, construction machinery, tanks, and penstocks, and also relates to a production method for this thick steel plate.

In particular, this disclosure relates to a high toughness and high tensile strength thick steel plate having a plate thickness of 100 mm or more, in which the yield strength of a mid-thickness part is 500 MPa or more, the reduction of area in the mid-thickness part by tension in a plate thickness direction is 40% or more, and the low-temperature toughness at −60° C. of the mid-thickness part is 70 J or more.

Herein, the phrase "excellent material homogeneity" is used with the meaning that hardness difference in the plate thickness direction is small.

BACKGROUND

When a steel material is to be used in any of various fields such as buildings, bridges, ships, marine structures, construction machinery, tanks, and penstocks, the steel material is made into a desired shape by welding in accordance with the shape of a steel structure for which the steel material is to be used. Recent years have seen the development of increasing large steel structures and the use of stronger and thicker steel materials at a remarkable rate.

A thick steel plate having a plate thickness of 100 mm or more is typically produced by blooming a large steel ingot produced by ingot casting and then hot rolling the obtained slab. In this ingot casting and blooming process, however, a concentrated segregation area of a hot top portion or a negative segregation area of a steel ingot bottom portion needs to be discarded. This hinders yield improvement, and leads to higher production cost and longer construction time.

On the other hand, in the case of producing a thick steel plate having a plate thickness of 100 mm or more by a process that uses a continuously-cast slab as a raw material, the aforementioned concern does not exist, but there is little working reduction to the product thickness because the continuously-cast slab is thin compared to a slab produced by ingot casting. Moreover, the general tendency to require stronger and thicker steel materials in recent years has increased the amount of alloying element added to ensure necessary properties. This causes new problems such as center porosity caused by center segregation and deterioration of inner quality due to upsizing.

To solve these problems, the following techniques have been proposed for use in a process of producing an ultra-thick steel plate from a continuously-cast slab, with the aim of compressing center porosity to improve the properties of the center segregation area in the steel plate.

For example, Non-Patent Literature (NPL) 1 describes a technique of compressing center porosity by increasing the rolling shape ratio in hot rolling of a continuously-cast slab.

JP S55-114404 A (PTL 1) and JP S61-273201 A (PTL 2) describe techniques of compressing center porosity in a continuously-cast slab by, in production of the continuously-cast slab, working the material using rolls or flat dies in a continuous casting machine.

JP 3333619 B (PTL 3) describes a technique of compressing center porosity by performing forging before hot rolling in production of a thick steel plate from a continuously-cast slab with a cumulative working reduction of 70% or less.

JP 2002-194431 A (PTL 4) describes a technique of not only eliminating center porosity but also reducing the center segregation zone to improve the resistance to temper embrittlement by, in production of an ultra-thick steel plate from a continuously-cast slab through forging and thick plate rolling with a total working reduction of 35% to 67%, holding a mid-thickness part of the raw material at a temperature of 1200° C. or higher for 20 hours or more before forging, and setting the working reduction of the forging to 16% or more.

JP 2000-263103 A (PTL 5) describes a technique of remedying center porosity and center segregation by cross-forging a continuously-cast slab and then hot rolling the slab.

JP 2006-111918 A (PTL 6) describes a production method for a thick steel plate having a tensile strength of 588 MPa or more, with center porosity being eliminated and the center segregation zone being reduced. In the production method, a continuously-cast slab is held at a temperature of 1200° C. or higher for 20 hours or more, the working reduction of forging is set to 17% or more, thick plate rolling is performed such that the total working reduction including the forging is in the range of 23% to 50%, and quenching is implemented twice after the thick plate rolling.

JP 2010-106298 A (PTL 7) describes a production method for a thick steel plate having excellent weldability and plate thickness direction ductility. In the production method, a continuously-cast slab having a specific chemical composition is reheated to at least 1100° C. and no higher than 1350° C., and is then hot worked at 1000° C. or higher with a strain rate of 0.05/s to 3/s and a cumulative working reduction of 15% or more.

CITATION LIST

Patent Literature

PTL 1: JP S55-114404 A
PTL 2: JP S61-273201 A
PTL 3: JP 3333619 B
PTL 4: JP 2002-194431 A
PTL 5: JP 2000-263103 A
PTL 6: JP 2006-111918 A
PTL 7: JP 2010-106298 A

Non-Patent Literature

NPL 1: Transactions of the Iron and Steel Institute of Japan, 66 (1980), pp. 201-210

SUMMARY

Technical Problem

However, the technique described in NPL 1 requires repeated rolling with a high rolling shape ratio to obtain a steel plate having good inner quality. This poses a problem in production due to exceeding the upper limit of the equipment specifications of a mill. If a typical method is used for rolling, the mid-thickness part cannot be worked sufficiently and, as a result, center porosity may remain and inner quality may not be improved.

The techniques described in PTL 1 and 2 require a larger continuous casting line to produce a thick steel plate having a plate thickness of 100 mm or more, and thus require significant capital investment.

The techniques described in PTL 3 to 7 are effective in center porosity reduction and center segregation zone improvement. However, when these techniques are adopted in the production of a thick steel plate with a plate thickness of 100 mm or more, a yield strength of 500 MPa or more, and a large addition amount of alloying element, the following problem may arise. Specifically, it is difficult to ensure toughness of the mid-thickness part at −60° C. using conventional rolling and forging methods since an increase in strength and thickness of the material is accompanied by a trade-off in terms of deterioration of toughness.

To solve the problems described above, it would be helpful if even in the case of a high strength thick steel plate in which an increase in the added amount of alloying element is required, a high tensile strength thick steel plate having excellent strength, elongation, and toughness in a mid-thickness part could be provided along with a production method for this thick steel plate.

Solution to Problem

The inventors aimed to solve the problems described above by conducting diligent research in which they investigated the controlling factors of microstructure within a steel plate in relation to strength, elongation, and toughness of a mid-thickness part, particularly focusing on thick steel plates having a plate thickness of 100 mm or more. Through their research, the inventors reached the following findings.

(A) To achieve good strength and toughness in the mid-thickness part of a steel plate, which has a significantly slower cooling rate than the surface of the steel plate, it is important to appropriately select the chemical composition of the steel such that the microstructure becomes a martensite and/or bainite structure even at a slow cooling rate.

(B) To ensure good ductility in the mid-thickness part of a thick steel plate, which tends to have lower ductility due to strengthening and higher defect sensitivity with respect to ductility, it is important to manage the die shape, total working reduction, and strain rate in hot forging to compress center porosity and render it harmless.

This disclosure is based on these findings and further investigation conducted by the inventors. The primary features of this disclosure are as follows.

1. A high toughness and high tensile strength thick steel plate having a plate thickness of 100 mm or more with excellent material homogeneity, having a chemical composition containing (consisting of), in mass %, C: 0.08% to 0.20%,
Si: 0.40% or less,
Mn: 0.5% to 5.0%,
P: 0.015% or less,
S: 0.0050% or less,
Ni: 5.0% or less,
Ti: 0.005% to 0.020%,
Al: 0.080% or less,
N: 0.0070% or less,
B: 0.0030% or less, and
one or more selected from
Cu: 0.50% or less,
Cr: 3.0% or less,
Mo: 1.50% or less,
V: 0.200% or less, and
Nb: 0.100% or less, the balance being Fe and incidental impurities, wherein a value $Ceq^{IIW}$ defined by formula (1) below is 0.55 to 0.80:

$$Ceq^{IIW}=C+Mn/6+(Cu+Ni)/15+(Cr+Mo+V)/5 \quad (1)$$

where each element symbol indicates content, in mass %, of a corresponding element in the chemical composition and is taken to be 0 when the corresponding element is not contained, a mid-thickness part of the steel plate has a yield strength of 500 MPa or more, reduction of area in the mid-thickness part by tension in a plate thickness direction is 40% or more, and the mid-thickness part has a low-temperature toughness at −60° C. of 70 J or more.

2. The high toughness and high tensile strength thick steel plate with excellent material homogeneity of the foregoing section 1, wherein the chemical composition further contains, in mass %, one or more selected from Mg: 0.0005% to 0.0100%,
Ta: 0.01% to 0.20%,
Zr: 0.005% to 0.1%,
Y: 0.001% to 0.01%,
Ca: 0.0005% to 0.0050%, and
REM: 0.0005% to 0.0200%.

3. The high toughness and high tensile strength thick steel plate with excellent material homogeneity of the foregoing section 1 or 2, wherein in a hardness distribution in the plate thickness direction, a difference ΔHV between average hardness of a plate thickness surface (HVS) and average hardness of the mid-thickness part (HVC), where ΔHV=HVS−HVC, is 30 or less.

4. A production method for the high toughness and high tensile strength thick steel plate with excellent material homogeneity of any one of the foregoing sections 1 to 3, comprising heating a continuously-cast slab having the chemical composition in the foregoing section 1 or 2 to at least 1200° C. and no higher than 1350° C., then hot forging the continuously-cast slab under conditions of a temperature of 1000° C. or higher, a strain rate of 3/s or less, and a cumulative working reduction of 15% or more using opposing dies having respective short sides differing such that when a short side length of a die having a shorter one of the short sides is taken to be 1, a short side length of a die having a longer one of the short sides is 1.1 to 3.0, then allowing cooling to obtain a steel raw material, then reheating the steel raw material to at least an $Ac_3$ temperature and no higher than 1250° C., then performing hot rolling of the steel raw material including at least two passes carried out with a rolling reduction of 4% or more per pass, then allowing cooling to obtain a thick steel plate, then reheating the thick steel plate to at least the $Ac_3$ temperature and no higher than 1050° C., then rapidly cooling the thick steel plate to 350° C. or lower, and then tempering the thick steel plate at at least 550° C. and no higher 700° C.

5. The production method of the foregoing section 4, wherein a working reduction ratio from the continuously-cast slab prior to working to the thick steel plate obtained after the hot rolling in production of the high toughness and high tensile strength thick steel plate is 3 or less.

Advantageous Effect

Through the disclosed techniques, it is possible to obtain a thick steel plate having a plate thickness of 100 mm or more, with excellent material homogeneity and excellent base metal strength, elongation, and toughness. Moreover, the disclosed techniques significantly contribute to increasing steel structure size, improving steel structure safety, improving yield, and shortening construction time, and are, therefore, industrially very useful. In particular, the disclosed techniques enable good properties to be obtained in the mid-thickness part without the need for measures such as increasing the scale of a continuous casting line, even in a situation in which the working reduction ratio from the pre-working slab is 3 or less. Note that conventionally, it has not been possible to achieve adequate properties in the mid-thickness part in this situation.

DETAILED DESCRIPTION

Figure 1:
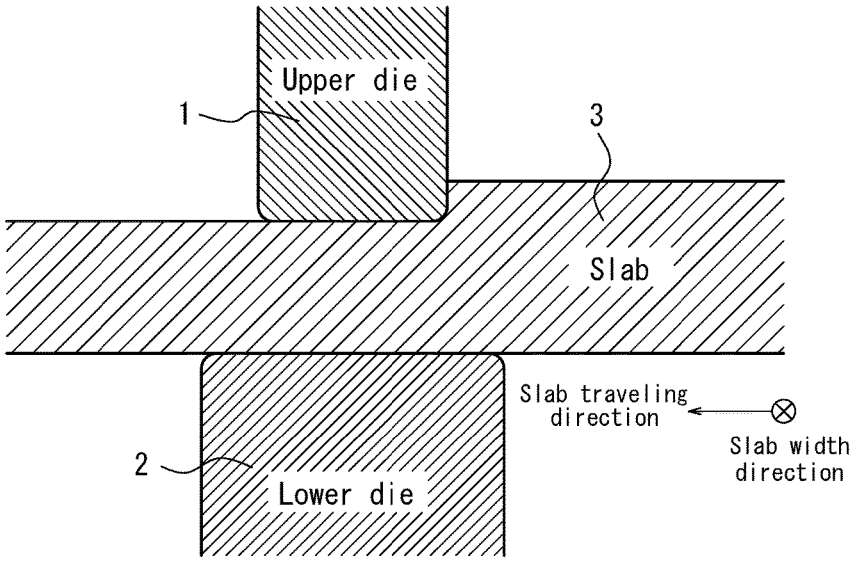
FIG. 1 illustrates the main points of forging a slab using asymmetrical dies according to this disclosure.

The following provides a detailed description of the disclosed techniques.

First, suitable ranges for the steel plate composition will be described. The contents of elements in the steel plate composition, shown in %, are all mass % values.

C: 0.08% to 0.20%

C is an element that is useful for obtaining the strength required for structural-use steel at low-cost. Addition of C in an amount of 0.08% or more is required to obtain this effect. On the other hand, an upper limit of 0.20% is set for the C content because C content exceeding 0.20% causes significant deterioration of base metal toughness and weld toughness. The C content is more preferably 0.08% or more. The C content is more preferably 0.14% or less.

Si: 0.40% or Less

Si is added for deoxidation. However, addition of Si in excess of 0.40% causes significant deterioration of base metal toughness and heat-affected zone toughness. Therefore, the Si content is set as 0.40% or less. The Si content is more preferably 0.05% or more. The Si content is more preferably 0.30% or less. The Si content is even more preferably 0.1% or more and 0.30% or less.

Mn: 0.5% to 5.0%

Mn is added to ensure base metal strength. However, this effect is not sufficiently obtained if less than 0.5% of Mn is added. On the other hand, an upper limit of 5.0% is set for the Mn content because addition of Mn in excess of 5.0% not only causes deterioration of base metal toughness, but also promotes central segregation and increases the scale of slab porosity. The Mn content is more preferably 0.6% or more. The Mn content is more preferably 2.0% or less. The Mn content is even more preferably 0.6% or more and 1.6% or less.

P: 0.015% or Less

The P content is limited to 0.015% or less because P content exceeding 0.015% significantly reduces base metal toughness and heat-affected zone toughness. The P content does not have a specific lower limit and may be 0%.

S: 0.0050% or Less

The S content is limited to 0.0050% or less because S content exceeding 0.0050% significantly reduces base metal toughness and heat-affected zone toughness. The S content does not have a specific lower limit and may be 0%.

Ni: 5.0% or Less

Ni is a useful element for improving steel strength and heat-affected zone toughness. However, an upper limit of 5.0% is set for the Ni content because addition of Ni in excess of 5.0% has a significant negative economical impact. The Ni content is more preferably 0.5% or more. The Ni content is more preferably 4.0% or less.

Ti: 0.005% to 0.020%

Ti forms TiN during heating, effectively inhibits coarsening of austenite, and improves base metal toughness and heat-affected zone toughness. Therefore, the Ti content is 0.005% or more. However, addition of Ti in excess of 0.020% causes coarsening of Ti nitrides and reduces base metal toughness. Therefore, the Ti content is set in a range of 0.005% to 0.020%. The Ti content is more preferably 0.008% or more. The Ti content is more preferably 0.015% or less.

Al: 0.080% or Less

Al is added to sufficiently deoxidize molten steel. However, addition of Al in excess of 0.080% causes a large amount of Al to dissolve in the base metal, leading to a decrease in base metal toughness. Therefore, the Al content is set as 0.080% or less. The Al content is more preferably 0.030% or more and 0.080% or less. The Al content is even more preferably 0.030% or more. The Al content is even more preferably 0.060% or less.

N: 0.0070% or Less

N has an effect of refining structure through formation of nitrides with Ti and the like, and thereby improving base metal toughness and heat-affected zone toughness. However, addition of N in excess of 0.0070% increases the amount of N dissolved in the base metal, leading to a significant decrease in base metal toughness, and also causes formation of coarse nitrides in the heat-affected zone, leading to a decrease in heat-affected zone toughness. Therefore, the N content is set as 0.0070% or less. The N content is more preferably 0.0050% or less. The N content is even more preferably 0.0040% or less. The N content does not have a specific lower limit and may be 0%.

B: 0.0030% or Less

B has an effect of inhibiting ferrite transformation at austenite grain boundaries by segregating at the grain boundaries, and thereby improving quench hardenability. However, addition of B in excess of 0.0030% causes precipitation of B as a carbonitride, leading to poorer quench hardenability and reduced toughness. Therefore, the B content is set as 0.0030% or less. The B content is more preferably 0.0003% or more. The B content is more preferably 0.0030% or less. The B content is even more preferably 0.0005% or more. The B content is even more preferably 0.0020% or less. The B content does not have a specific lower limit and may be 0%.

In addition to the elements described above, one or more selected from Cu, Cr, Mo, V, and Nb are contained in the steel plate composition to further increase strength and/or toughness.

Cu: 0.50% or Less

Cu can improve the strength of steel without loss of toughness. However, addition of Cu in excess of 0.50% causes cracking of the surface of the steel plate during hot working. Therefore, the Cu content is set as 0.50% or less. The Cu content does not have a specific lower limit and may be 0%.

Cr: 3.0% or Less

Cr is an effective element for strengthening the base metal. However, the Cr content is set as 3.0% or less because addition of a large amount of Cr reduces weldability. The Cr content is more preferably 0.1% or more. The Cr content is more preferably 2.0% or less from a viewpoint of production cost.

Mo: 1.50% or Less

Mo is an effective element for strengthening the base metal. However, an upper limit of 1.50% is set for the Mo content because addition of Mo in excess of 1.50% causes precipitation of a hard alloy carbide, leading to an increase in strength and a decrease in toughness. The Mo content is more preferably 0.02% or more. The Mo content is more preferably 0.80% or less.

V: 0.200% or Less

V has an effect of improving base metal strength and/or toughness and effectively reduces the amount of solute N through precipitation as VN. However, addition of V in excess of 0.200% reduces toughness of the steel due to precipitation of hard VC. Therefore, the V content is set as 0.200% or less. The V content is more preferably 0.005% or more. The V content is more preferably 0.100% or less.

Nb: 0.100% or Less

Nb is useful due to an effect of strengthening the base metal. However, an upper limit of 0.100% is set for the Nb content because addition of Nb in excess of 0.100% significantly reduces base metal toughness. The Nb content is more preferably 0.025% or less.

In addition to the basic components described above, one or more selected from Mg, Ta, Zr, Y, Ca, and REM may be contained in the steel plate composition to further enhance material quality.

Mg: 0.0005% to 0.0100%

Mg forms a stable oxide at high temperature and effectively inhibits coarsening of prior γ (austenite) grains in a heat-affected zone, and is thus an effective element for improving weld toughness. Therefore, the Mg content is preferably 0.0005% or more. However, addition of Mg in excess of 0.0100% increases the amount of inclusions and reduces toughness. Therefore, in a situation in which Mg is added, the Mg content is preferably 0.0100% or less. The Mg content is more preferably 0.0005% or more and 0.0050% or less.

Ta: 0.01% to 0.20%

Ta effectively improves strength when added in an appropriate amount. However, no clear effect is obtained when less than 0.01% of Ta is added. Therefore, the Ta content is preferably 0.01% or more. On the other hand, addition of Ta in excess of 0.20% reduces toughness due to precipitate formation. Therefore, the Ta content is preferably 0.20% or less.

Zr: 0.005% to 0.1%

Zr is an effective element for increasing strength. However, no clear effect is obtained when less than 0.005% of Zr is added. Therefore, the Zr content is preferably 0.005% or more. On the other hand, addition of Zr in excess of 0.1% reduces toughness due to formation of a coarse precipitate. Therefore, the Zr content is preferably 0.1% or less.

Y: 0.001% to 0.01%

Y forms a stable oxide at high temperature and effectively inhibits coarsening of prior γ grains in a heat-affected zone, and is thus an effective element for improving weld toughness. However, these effects are not obtained if less than 0.001% of Y is added. Therefore, the Y content is preferably 0.001% or more. On the other hand, addition of Y in excess of 0.01% increases the amount of inclusions and reduces toughness. Therefore, the Y content is preferably 0.01% or less.

Ca: 0.0005% to 0.0050%

Ca is a useful element for morphological control of sulfide inclusions. In a situation in which Ca is added, the Ca content is preferably 0.0005% or more in order to display this effect. However, addition of Ca in excess of 0.0050% leads to a decrease in the cleanliness factor and causes deterioration of toughness. Therefore, in a situation in which Ca is added, the Ca content is preferably 0.0050% or less. The Ca content is more preferably 0.0005% or more and 0.0025% or less.

REM: 0.0005% to 0.0200%

REM (rare earth metal) has an effect of improving material quality by forming oxides and sulfides in the steel in the same way as Ca. However, this effect in not obtained unless the REM content is 0.0005% or more. Moreover, this effect reaches saturation when REM is added in excess of 0.0200%. Therefore, in a situation in which REM is added, the REM content is preferably 0.0200% or less. The REM content is more preferably 0.0005% or more. The REM content is more preferably 0.0100% or less.

The basic components and selectable components of the steel plate composition have been described through the above. In addition, it is important that the equivalent carbon content, indicated by $Ceq^{IIW}$, is in an appropriate range.

$Ceq^{IIW}$ (%): 0.55 to 0.80

In the presently disclosed techniques, it is required that appropriate components are added to ensure that the mid-thickness part has a yield strength of 500 MPa or more and good low-temperature toughness at −60° C. It is also required that the composition is adjusted such that $Ceq^{IIW}$ (%), defined by the following formula (1), is 0.55 to 0.80.

$$Ceq^{IIW}=C+Mn/6+(Cu+Ni)/15+(Cr+Mo+V)/5 \quad (1)$$

Each element symbol indicates the content, in mass %, of the corresponding element.

By adopting the forging process described below with respect to a thick steel plate having a plate thickness of 100 mm or more and having the chemical composition described above, center porosity in a mid-thickness part of the thick steel plate can be compressed and thus rendered substantially harmless.

Moreover, by subsequently adopting the hot working process described below, strength, ductility, and toughness of the mid-thickness part of the steel plate can be improved, and thus a yield strength in the mid-thickness part of 500 MPa or more, a reduction of area in the mid-thickness part by tension in a plate thickness direction of 40% or more, and a low-temperature toughness at −60° C. in the mid-thickness part of 70 J or more can be achieved.

In the case of a thick steel plate having a plate thickness of 100 mm or more and a yield strength of 500 MPa or more, a hardness distribution in the plate thickness direction of the steel plate is typically high at the surface of the steel plate and falls toward a mid-thickness part of the steel plate. If the composition of the steel plate is inappropriate and quench hardenability is insufficient, a structure of mainly ferrite and upper bainite forms, leading to greater variation in the hardness distribution in the plate thickness direction (i.e., a greater difference between hardness near the surface and hardness of the mid-thickness part), and thus poorer material homogeneity.

Herein, appropriate adjustment of the steel plate composition as described above ensures quench hardenability, resulting in a microstructure that is a martensite and/or bainite structure.

In particular, material homogeneity can be further improved when, in the plate thickness direction hardness distribution, the difference ΔHV between the average hardness of the plate thickness surface (HVS) and the average hardness of the mid-thickness part (HVC), where ΔHV=HVS−HVC, is 30 or less.

The average hardness of the plate thickness surface (HVS) and the average hardness of the mid-thickness part (HVC) can be determined, for example, from a cross-section parallel to a longitudinal direction of the steel plate by measuring the hardness at a number of points at a position 2 mm inward from the steel plate surface and a number of points at a mid-thickness position in the cross-section, and then determining an average value for each of these positions.

The following describes production conditions in the presently disclosed techniques.

In the following description, temperatures given in "° C." refer to the temperature of the mid-thickness part. The presently disclosed production method for a steel plate requires, in particular, that a steel raw material be hot forged under the following conditions to render harmless casting defects such as center porosity in the steel raw material.

I. Hot Forging Conditions of Steel Raw Material

Heating Temperature: 1200° C. to 1350° C.

A steel raw material for a cast steel or slab having the aforementioned composition is subjected to steelmaking and continuous casting by a typically known method, such as using a converter, an electric heating furnace, or a vacuum melting furnace, and is then reheated to at least 1200° C. and no higher than 1350° C. If the reheating temperature is lower than 1200° C., a predetermined cumulative working reduction and temperature lower limit cannot be ensured in hot forging and deformation resistance during the hot forging is high, making it impossible to ensure a sufficient per-pass working reduction. As a result, a larger number of passes are needed, which not only reduces production efficiency, but also makes it impossible to compress casting defects such as center porosity in the steel raw material to render them harmless. Therefore, the slab reheating temperature is set as 1200° C. or higher. An upper limit of 1350° C. is set for the reheating temperature because reheating to a temperature higher than 1350° C. consumes excessive energy and facilitates formation of surface defects due to scale during heating, leading to an increased mending load after hot forging.

Hot forging according to this disclosure is performed using a pair of opposing dies whose long sides lie in the width direction of the continuously-cast slab and whose short sides lie in the traveling direction of the continuously-cast slab. A feature of the hot forging according to this disclosure is that the respective short sides of the opposing dies have different lengths, as illustrated in FIG. 1.

In FIG. 1, reference sign 1 indicates an upper die, reference sign 2 indicates a lower die, and reference sign 3 indicates a slab.

Among the opposing upper and lower dies, when the short side length of the die having a shorter one of the short sides (i.e., the upper die in FIG. 1) is taken to be 1, the short side length of the opposing die having a longer one of the short sides (i.e., the lower die in FIG. 1) is set such as to be from 1.1 times to 3.0 times the short side length of the die having the shorter one of the short sides. As a result, not only can an asymmetrical strain distribution be obtained within the steel material, but also a position of minimum strain application during forging can be set so as not to coincide with a position at which center porosity of the continuously-cast slab occurs. This makes it possible to ensure that the center porosity is rendered harmless.

If the ratio of the longer one of the short sides to the shorter one of the short sides is less than 1.1, the effect of rendering center porosity harmless is not sufficiently achieved. On the other hand, if the ratio of the longer one of the short sides to the shorter one of the short sides exceeds 3.0, the efficiency of hot forging drops significantly. Accordingly, it is important that, with regards to the respective short side lengths of the pair of opposing dies used in the hot forging according to this disclosure, when the shorter one of the short side lengths is taken to be 1, the longer one of the short side lengths is set as 1.1 to 3.0. It should be noted that so long as the respective short side lengths of the opposing dies satisfy the ratio described above, it does not matter whether the die having the shorter one of the short side lengths is located above or below the continuously-cast slab. In other words, the lower die in FIG. 1 may alternatively be the die having the shorter one of the short side lengths.

Figure 2:
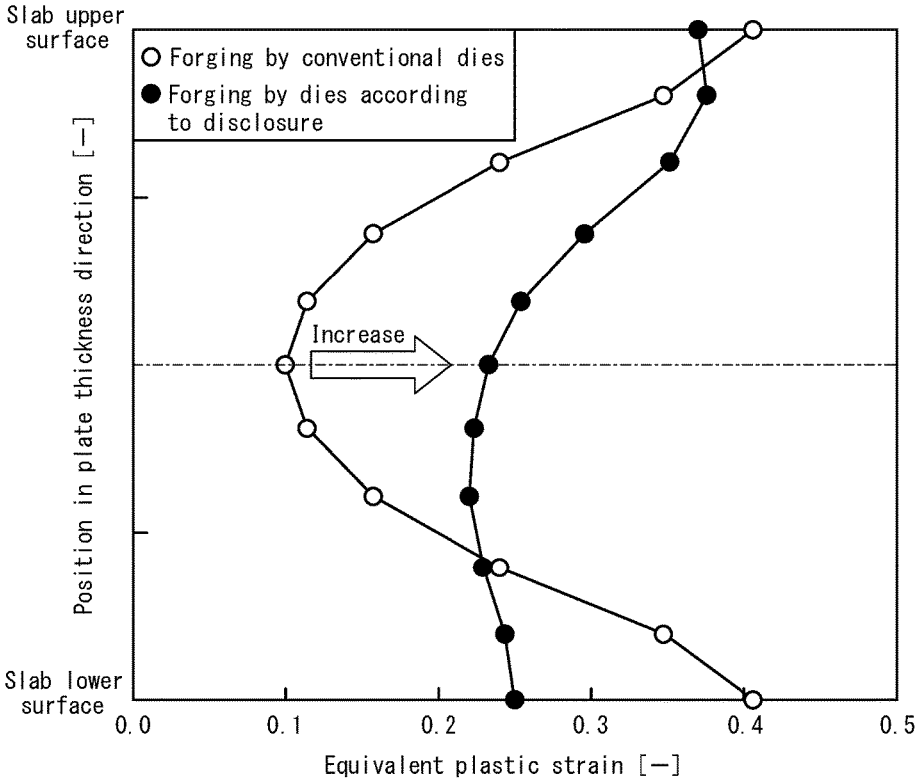
FIG. 2 compares equivalent plastic strain in a raw material (steel plate) when conventional symmetrical dies (dies having upper/lower symmetry) are used and when asymmetrical dies (dies not having upper/lower symmetry) according to this disclosure are used.

FIG. 2 compares the equivalent plastic strain in a slab, calculated in a thickness direction of the slab, when hot forging was performed using dies for which the respective short side lengths of the upper and lower dies are the same (conventional dies indicated by white circles in FIG. 2) and when hot forging was performed using dies for which the ratio of short side lengths of a die having a shorter short side and a die having a longer short side is 2.5 (dies according to this disclosure indicated by black circles in FIG. 2). With the exception of the die shape, the hot forging was performed with both pairs of dies under the same conditions of a heating temperature of 1250° C., a working start temperature of 1215° C., a working end temperature of 1050° C., a cumulative working reduction of 16%, a strain rate of 0.1/s, and a maximum working reduction per pass of 8%, and without width direction working.

FIG. 2 clearly illustrates that hot forging using the dies according to this disclosure was more successful in imparting sufficient strain to the center of the slab.

Hot Forging Temperature: 1000° C. or Higher

A forging temperature of lower than 1000° C. in the hot forging raises deformation resistance during the hot forging and thus increases the load on the forging machine, making it impossible to ensure that center porosity is rendered harmless. Therefore, the forging temperature is set as 1000° C. or higher. The forging temperature does not have a specific upper limit but is preferably no higher than approximately 1350° C. in view of production costs.

Cumulative Working Reduction of Hot Forging: 15% or More

If the cumulative working reduction of the hot forging is less than 15%, casting defects such as center porosity in the steel raw material cannot be compressed and rendered harmless. Therefore, the cumulative working reduction is set as 15% or more. Although casting defects can be more effectively rendered harmless with increasing cumulative working reduction, an upper limit of approximately 30% is set for the cumulative working reduction in view of manufacturability. In a situation in which the thickness is increased through hot forging in the width direction of the continuously-cast slab, the cumulative working reduction is measured from the increased thickness.

Particularly in production of a thick steel plate having a plate thickness of 120 mm or more, it is preferable to ensure that at least one pass is performed with a working reduction of 5% or more per pass in the hot forging to ensure that center porosity is rendered harmless. The working reduction per pass is more preferably 7% or more.

Strain Rate of Hot Forging: 3/s or Less

A strain rate exceeding 3/s in the hot forging raises deformation resistance during the hot forging and thus increases the load on the forging machine, making it impossible to ensure that center porosity is rendered harmless. Therefore, the strain rate is set as 3/s or less.

On the other hand, a strain rate of less than 0.01/s lengthens the hot forging time, leading to lower productivity. Therefore, the strain rate is preferably 0.01/s or more. The strain rate is more preferably 0.05/s or more. The strain rate is more preferably 1/s or less.

In the disclosed techniques, the hot forging is followed by hot working to obtain a steel plate of a desired plate thickness and improve strength and toughness of the mid-thickness part.

II. Conditions of Hot Working after Forging

Reheating Temperature of Steel Raw Material after Forging: $Ac_3$ Temperature to 1250° C.

The steel raw material is reheated to the $Ac_3$ transformation temperature or higher after the hot forging to homogenize the steel as a single austenite phase. The reheating temperature is required to be at least the $Ac_3$ temperature and no higher than 1250° C.

Herein, the $Ac_3$ transformation temperature is taken to be a value calculated according to formula (2), shown below.

$$Ac_3\ (°\ C.)=937.2-476.5C+56Si-19.7Mn-16.3Cu-26.6Ni-4.9Cr+38.1Mo+124.8V+136.3Ti+198.4Al+3315B \quad (2)$$

Each element symbol in formula (2) indicates the content, in mass %, of the corresponding alloying element in the steel.

Performance of hot rolling including at least two passes carried out with a rolling reduction of 4% or more per pass In the presently disclosed techniques, the reheating to at least the $Ac_3$ temperature and no higher than 1250° C. is followed by hot rolling including at least two passes carried out with a rolling reduction of 4% or more per pass. Such rolling allows sufficient working of the mid-thickness part. This can refine structure by promoting recrystallization and can contribute to improving mechanical properties. The number of passes carried out in the hot rolling is preferably 10 or less because mechanical properties improve as the number of passes is reduced.

Conditions of Heat Treatment after Hot Rolling

In the presently disclosed techniques, the steel is allowed to cool after the hot rolling, is then reheated again to at least the $Ac_3$ temperature and no higher than 1050° C., and is subsequently rapidly cooled from the $Ar_3$ temperature or higher to 350° C. or lower to improve strength and toughness of the mid-thickness part. The reheating temperature is set as 1050° C. or lower because reheating to a high temperature exceeding 1050° C. significantly reduces base metal toughness due to austenite grain coarsening.

Herein, the $Ar_3$ transformation temperature is taken to be a value calculated according to formula (3), shown below.

$$Ar_3\ (°\ C.)=910-310C-80Mn-20Cu-15Cr-55Ni-80Mo \quad (3)$$

Each element symbol in formula (3) indicates the content, in mass %, of the corresponding alloying element in the steel.

The temperature of the mid-thickness part is determined by simulation calculation or the like based on the plate thickness, surface temperature, cooling conditions, and so forth. For example, the temperature of the mid-thickness part may be determined by calculating a temperature distribution in the plate thickness direction by the finite difference method.

In industry, the method of rapid cooling is normally water cooling. However, a cooling method other than water cooling, such as gas cooling or the like, may be adopted because the cooling rate is preferably as fast as possible.

Tempering Temperature: 550° C. to 700° C.

The rapid cooling is followed by tempering at at least 550° C. and no higher than 700° C. The reason for this is that a tempering temperature of lower than 550° C. does not effectively remove residual stress, whereas a tempering temperature exceeding 700° C. causes precipitation of various carbides and coarsens the structure of the base metal, leading to a significant decrease in strength and toughness. In particular, tempering at a temperature of 600° C. or higher is preferable for adjusting yield strength and improving low-temperature toughness in the tempering step. Tempering at a temperature of 650° C. or higher is more preferable.

In industry, there are instances in which steel is quenched repeatedly to make the steel tougher. While quenching may be performed repeatedly in the disclosed techniques, the final quenching is required to involve heating to at least the $Ac_3$ temperature and no higher than 1050° C., subsequent rapid cooling to 350° C. or lower, and subsequent tempering at at least 550° C. and no higher than 700° C.

Conventional techniques struggle to achieve the excellent properties described above in a situation in which the working reduction ratio from the slab prior to working is 3 or less. However, according to the presently disclosed techniques, the desired properties can be achieved even in this situation.

By performing quenching and tempering as described above in production of a steel plate according to this disclosure, a steel plate having excellent strength and toughness can be produced.

EXAMPLES

Steels 1-32 shown in Table 1 were produced by steel making to obtain continuously-cast slabs that were then subjected to hot forging and hot rolling under the conditions shown in Table 2. The number of passes of hot rolling was 10 or less. The plate thickness after the hot rolling was in a range of 100 mm to 240 mm. After the hot rolling, quenching and tempering were performed under the conditions shown in Table 3 to produce steel plates indicated as samples 1-44 in Tables 2 and 3. The produced steel plates were tested as follows.

(1) Tensile Test

A round bar tensile test piece (Φ: 12.5 mm, GL: 50 mm) was sampled from a mid-thickness part of each of the steel plates in a direction perpendicular to the rolling direction and was used to measure yield strength (YS) and tensile strength (TS).

(2) Plate Thickness Direction Tensile Test

Three round bar tensile test pieces (φ10 mm) were collected from each of the steel plates in the plate thickness direction, the reduction of area after fracture was measured, and evaluation was conducted using the smallest value of the three test pieces.

(3) Charpy Impact Test

Three 2 mm V notch Charpy test pieces having a longitudinal direction corresponding to the rolling direction were collected from the mid-thickness part of each of the steel plates, absorbed energy ($_{V}E_{-60}$) was measured for each test piece by a Charpy impact test at −60° C., and the average of the three test pieces was calculated.

(4) Hardness Measurement

Test pieces for hardness measurement were collected from the surface and the mid-thickness part of each of the steel plates such that hardness of a cross-section parallel to the longitudinal direction of the steel plate could be measured. Each of the test pieces was embedded and polished. Thereafter, a Vickers hardness meter was used to measure the hardness of three points at a surface position (position 2 mm inward from the surface) and three points at a mid-thickness position (middle position) using a load of 98 N (10 kgf). An average value for each set of three points was calculated as the average hardness of the corresponding position. The hardness difference ΔHV was calculated according to: ΔHV=average hardness of plate thickness surface−average hardness of mid-thickness part.

Results of the tests described above are shown in Table 3.

TABLE 1

Table 1

| Steel | Chemical composition (mass %) | | | | | | | | | | | | | | |
|---|---|---|---|---|---|---|---|---|---|---|---|---|---|---|---|
| no. | C | Si | Mn | P | S | Ni | Ti | Al | N | B | Cu | Cr | Mo | V | Nb |
| 1 | 0.081 | 0.15 | 1.6 | 0.008 | 0.0009 | 0.6 | 0.010 | 0.043 | 0.0035 | 0.0012 | 0.26 | 0.8 | 0.25 | 0.020 | — |
| 2 | 0.087 | 0.10 | 1.3 | 0.004 | 0.0011 | 0.9 | 0.009 | 0.049 | 0.0030 | 0.0011 | 0.22 | 1.0 | 0.31 | 0.025 | — |
| 3 | 0.105 | 0.15 | 1.1 | 0.007 | 0.001 | 1.0 | 0.007 | 0.045 | 0.0033 | 0.0011 | 0.24 | 0.7 | 0.43 | 0.041 | — |
| 4 | 0.115 | 0.21 | 1.2 | 0.006 | 0.0007 | 1.5 | 0.010 | 0.035 | 0.0029 | 0.0010 | 0.11 | 0.9 | 0.35 | 0.034 | — |
| 5 | 0.119 | 0.17 | 1.2 | 0.005 | 0.0009 | 1.9 | 0.012 | 0.041 | 0.0030 | 0.0012 | 0.20 | 1.0 | 0.48 | 0.025 | 0.012 |
| 6 | 0.123 | 0.21 | 1.1 | 0.005 | 0.0007 | 2.1 | 0.010 | 0.045 | 0.0027 | 0.0010 | 0.19 | 0.8 | 0.44 | 0.042 | — |
| 7 | 0.120 | 0.16 | 1.1 | 0.004 | 0.0006 | 3.4 | 0.005 | 0.066 | 0.0042 | 0.0012 | 0.20 | 0.4 | 0.45 | 0.021 | — |
| 8 | 0.122 | 0.19 | 1.2 | 0.003 | 0.0004 | 2.2 | 0.011 | 0.044 | 0.0031 | 0.0012 | 0.15 | 0.9 | 0.46 | 0.035 | — |
| 9 | 0.125 | 0.20 | 1.2 | 0.005 | 0.0006 | 2.1 | 0.012 | 0.060 | 0.0040 | 0.0010 | — | 1.0 | 0.55 | 0.045 | — |
| 10 | 0.115 | 0.17 | 1.1 | 0.005 | 0.0006 | 2.4 | 0.010 | 0.055 | 0.0032 | 0.0012 | 0.20 | 0.8 | 0.50 | 0.040 | — |
| 11 | 0.160 | 0.23 | 1.5 | 0.004 | 0.0005 | 2.0 | 0.008 | 0.048 | 0.0029 | 0.0009 | 0.20 | 0.8 | — | — | — |
| 12 | 0.179 | 0.11 | 0.6 | 0.003 | 0.0003 | 4.2 | 0.009 | 0.053 | 0.0025 | 0.0008 | — | — | 0.50 | — | — |
| 13 | 0.193 | 0.21 | 0.9 | 0.004 | 0.0009 | 2.2 | 0.011 | 0.050 | 0.0028 | 0.0012 | — | 1.0 | — | 0.015 | — |
| 14 | 0.125 | 0.22 | 1.2 | 0.006 | 0.0005 | 2.0 | 0.009 | 0.045 | 0.0024 | — | 0.15 | 0.7 | 0.42 | 0.043 | — |
| 15 | 0.119 | 0.24 | 1.1 | 0.005 | 0.0008 | 1.9 | 0.012 | 0.005 | 0.0025 | 0.0011 | 0.21 | 0.9 | 0.50 | 0.045 | — |
| 16 | 0.120 | 0.04 | 0.6 | 0.003 | 0.0006 | 0.1 | 0.010 | 0.027 | 0.0039 | 0.0009 | — | 1.8 | 0.87 | 0.090 | — |
| 17 | 0.123 | 0.13 | 1.1 | 0.003 | 0.0004 | 1.8 | 0.011 | 0.035 | 0.0028 | 0.0012 | 0.20 | 0.9 | 0.50 | 0.045 | — |
| 18 | 0.129 | 0.24 | 1.2 | 0.005 | 0.0012 | 0.9 | 0.008 | 0.004 | 0.0022 | 0.0006 | 0.25 | 1.0 | 0.45 | — | — |
| 19 | 0.139 | 0.17 | 1.3 | 0.006 | 0.0009 | 1.5 | 0.009 | 0.004 | 0.0028 | 0.0009 | 0.30 | 0.6 | 0.50 | 0.004 | — |
| 20 | 0.110 | 0.28 | 1.1 | 0.006 | 0.001 | 0.5 | 0.010 | 0.040 | 0.0030 | 0.0010 | 0.21 | 0.7 | 0.44 | 0.150 | — |
| 21 | 0.122 | 0.21 | 0.7 | 0.005 | 0.0008 | 1.0 | 0.009 | 0.035 | 0.0028 | 0.0006 | 0.25 | 0.9 | 0.45 | 0.060 | 0.009 |
| 22 | 0.228 | 0.25 | 1.3 | 0.005 | 0.0009 | 0.6 | 0.009 | 0.043 | 0.0030 | 0.0012 | 0.35 | 1.1 | 0.44 | 0.038 | — |
| 23 | 0.152 | 0.56 | 1.0 | 0.006 | 0.0006 | 0.9 | 0.010 | 0.044 | 0.0032 | 0.0015 | 0.17 | 0.9 | 0.52 | — | — |
| 24 | 0.105 | 0.40 | 0.3 | 0.009 | 0.0015 | 1.1 | 0.009 | 0.050 | 0.0030 | 0.0012 | 0.22 | 1.3 | 0.58 | 0.035 | — |
| 25 | 0.136 | 0.35 | 1.2 | 0.019 | 0.0012 | 0.5 | 0.011 | 0.045 | 0.0038 | 0.0009 | 0.26 | 1.0 | 0.52 | 0.045 | — |
| 26 | 0.144 | 0.15 | 1.3 | 0.011 | 0.007 | 1.2 | 0.011 | 0.025 | 0.0055 | 0.0006 | 0.13 | 1.1 | 0.44 | 0.039 | — |
| 27 | 0.082 | 0.26 | 1.6 | 0.006 | 0.0005 | 1.6 | 0.003 | 0.050 | 0.0040 | 0.0005 | — | 0.6 | 0.35 | — | — |
| 28 | 0.093 | 0.29 | 1.0 | 0.005 | 0.0007 | 1.5 | 0.024 | 0.035 | 0.0041 | 0.0008 | — | 0.9 | 0.41 | 0.010 | — |
| 29 | 0.122 | 0.26 | 1.1 | 0.006 | 0.0009 | 1.5 | 0.011 | 0.095 | 0.0039 | 0.0006 | 0.44 | 1.0 | 0.44 | — | — |
| 30 | 0.120 | 0.26 | 1.1 | 0.007 | 0.001 | 2.0 | 0.006 | 0.040 | 0.0085 | 0.0005 | 0.33 | 0.7 | 0.60 | — | — |
| 31 | 0.130 | 0.26 | 1.1 | 0.008 | 0.0011 | 2.1 | 0.008 | 0.044 | 0.0030 | 0.0040 | 0.26 | 0.8 | 0.50 | — | — |
| 32 | 0.105 | 0.17 | 0.8 | 0.014 | 0.0015 | 1.2 | 0.012 | 0.035 | 0.0030 | 0.0009 | 0.17 | 0.5 | 0.35 | 0.020 | — |

| Steel | Chemical composition (mass %) | | | | | | | $Ac_3$ | $Ar_3$ | |
|---|---|---|---|---|---|---|---|---|---|---|
| no. | Mg | Ta | Zr | Y | Ca | REM | $Ceq^{IIW}$ | ° C. | ° C. | Remarks |
| 1 | — | — | — | — | 0.0020 | — | 0.62 | 877 | 687 | Conforming steel |
| 2 | — | — | — | — | — | 0.0110 | 0.65 | 873 | 685 | Conforming steel |
| 3 | — | — | — | — | 0.0014 | — | 0.60 | 875 | 686 | Conforming steel |
| 4 | — | — | — | — | 0.0015 | — | 0.68 | 854 | 652 | Conforming steel |
| 5 | — | — | — | — | 0.0021 | — | 0.75 | 843 | 616 | Conforming steel |
| 6 | — | — | — | — | 0.0013 | — | 0.72 | 841 | 617 | Conforming steel |
| 7 | — | — | — | — | 0.0022 | — | 0.72 | 809 | 552 | Conforming steel |
| 8 | — | — | — | — | 0.0019 | — | 0.75 | 838 | 606 | Conforming steel |
| 9 | — | — | — | — | 0.0017 | — | 0.78 | 849 | 605 | Conforming steel |
| 10 | — | — | — | — | — | 0.0051 | 0.74 | 840 | 598 | Conforming steel |
| 11 | — | — | — | — | 0.0023 | — | 0.72 | 798 | 614 | Conforming steel |
| 12 | — | — | — | — | — | — | 0.66 | 768 | 536 | Conforming steel |
| 13 | — | — | — | — | 0.0018 | — | 0.69 | 793 | 642 | Conforming steel |
| 14 | — | — | — | — | 0.0016 | — | 0.69 | 839 | 619 | Conforming steel |
| 15 | — | — | — | — | 0.0015 | — | 0.73 | 845 | 623 | Conforming steel |
| 16 | — | — | — | — | — | — | 0.78 | 913 | 723 | Conforming steel |
| 17 | 0.0020 | — | — | — | 0.0017 | — | 0.73 | 846 | 627 | Conforming steel |

TABLE 1-continued

Table 1

| | | | | | | | | | | |
|---|---|---|---|---|---|---|---|---|---|---|
| 18 | — | 0.055 | — | — | 0.0013 | — | 0.70 | 854 | 669 | Conforming steel |
| 19 | — | — | 0.007 | — | 0.0020 | — | 0.70 | 832 | 625 | Conforming steel |
| 20 | — | — | — | 0.004 | 0.0010 | — | 0.60 | 907 | 711 | Conforming steel |
| 21 | — | — | — | — | — | — | 0.60 | 877 | 707 | Conforming steel |
| 22 | — | — | — | — | — | — | 0.82 | 825 | 644 | Comparative steel |
| 23 | — | — | — | — | — | — | 0.67 | 880 | 675 | Comparative steel |
| 24 | — | — | — | — | 0.0021 | — | 0.63 | 906 | 723 | Comparative steel |
| 25 | — | — | — | — | — | 0.0097 | 0.70 | 885 | 683 | Comparative steel |
| 26 | — | — | — | — | 0.0011 | — | 0.77 | 842 | 641 | Comparative steel |
| 27 | — | — | — | — | 0.0023 | — | 0.65 | 861 | 632 | Comparative steel |
| 28 | — | — | — | — | — | — | 0.62 | 875 | 672 | Comparative steel |
| 29 | — | — | — | — | 0.0023 | — | 0.72 | 859 | 643 | Comparative steel |
| 30 | — | — | — | — | — | — | 0.72 | 844 | 610 | Comparative steel |
| 31 | — | — | — | — | 0.0023 | — | 0.73 | 846 | 609 | Comparative steel |
| 32 | — | — | — | — | 0.0016 | — | 0.50 | 871 | 709 | Comparative steel |

Values for $Ceq^{IIW}$, $Ac_3$, and $Ar_3$ were calculated according to formulae (1) to (3) in the specification
Underlining indicates deviation from the scope of this disclosure

TABLE 2

Table 2

| | | | Hot forging | | | | | |
|---|---|---|---|---|---|---|---|---|
| Sample no. | Steel no. | Slab thickness (mm) | Heating temperature (° C.) | Working start temperature (° C.) | Working end temperature (° C.) | Cumulative working reduction (%) | Strain rate (/s) | Maximum working reduction per pass (%) |
| 1 | 1 | 250 | 1200 | 1155 | 1020 | 20 | 0.1 | 10 |
| 2 | 2 | 250 | 1270 | 1160 | 1120 | 15 | 0.1 | 7 |
| 3 | 3 | 310 | 1200 | 1170 | 1020 | 15 | 0.1 | 5 |
| 4 | 4 | 450 | 1250 | 1235 | 1060 | 15 | 0.1 | 10 |
| 5 | 5 | 310 | 1270 | 1245 | 1120 | 20 | 0.1 | 10 |
| 6 | 6 | 310 | 1270 | 1240 | 1120 | 20 | 0.1 | 10 |
| 7 | 7 | 310 | 1270 | 1245 | 1100 | 20 | 0.1 | 10 |
| 8 | 8 | 310 | 1200 | 1165 | 1050 | 20 | 0.1 | 5 |
| 9 | 9 | 450 | 1270 | 1250 | 1080 | 15 | 0.1 | 10 |
| 10 | 10 | 310 | 1250 | 1220 | 1120 | 20 | 0.1 | 7 |
| 11 | 11 | 310 | 1250 | 1215 | 1150 | 20 | 0.1 | 7 |
| 12 | 12 | 310 | 1270 | 1245 | 1100 | 20 | 0.1 | 10 |
| 13 | 13 | 310 | 1300 | 1270 | 1150 | 20 | 0.1 | 10 |
| 14 | 14 | 250 | 1200 | 1160 | 1050 | 15 | 0.1 | 5 |
| 15 | 15 | 310 | 1270 | 1235 | 1100 | 20 | 0.1 | 10 |
| 16 | 16 | 450 | 1270 | 1255 | 1050 | 15 | 0.1 | 10 |
| 17 | 17 | 310 | 1200 | 1165 | 1050 | 20 | 0.1 | 5 |
| 18 | 18 | 310 | 1270 | 1235 | 1050 | 15 | 0.1 | 10 |
| 19 | 19 | 310 | 1270 | 1245 | 1100 | 20 | 0.1 | 10 |
| 20 | 20 | 250 | 1200 | 1135 | 1050 | 15 | 0.1 | 5 |
| 21 | 21 | 250 | 1270 | 1150 | 1050 | 20 | 0.1 | 10 |
| 22 | 22 | 310 | 1200 | 1165 | 1030 | 15 | 0.1 | 5 |
| 23 | 23 | 250 | 1200 | 1145 | 1050 | 15 | 0.1 | 10 |
| 24 | 24 | 250 | 1200 | 1150 | 1050 | 15 | 0.1 | 10 |
| 25 | 25 | 310 | 1270 | 1235 | 1100 | 20 | 0.1 | 10 |
| 26 | 26 | 310 | 1270 | 1240 | 1100 | 20 | 0.1 | 10 |
| 27 | 27 | 310 | 1270 | 1250 | 1100 | 20 | 0.1 | 10 |
| 28 | 28 | 310 | 1270 | 1250 | 1100 | 20 | 0.1 | 10 |
| 29 | 29 | 310 | 1270 | 1245 | 1100 | 20 | 0.1 | 10 |
| 30 | 30 | 310 | 1270 | 1235 | 1100 | 20 | 0.1 | 10 |
| 31 | 31 | 310 | 1270 | 1235 | 1100 | 20 | 0.1 | 10 |
| 32 | 32 | 310 | 1270 | 1250 | 1100 | 20 | 0.1 | 10 |
| 33 | 5 | 310 | 1050 | 1005 | 850 | 15 | 0.1 | 3 |
| 34 | 5 | 310 | 1200 | 1165 | 900 | 15 | 0.1 | 4 |
| 35 | 5 | 310 | 1200 | 1165 | 1050 | 7 | 0.1 | 4 |
| 36 | 5 | 310 | 1200 | 1170 | 1050 | 15 | 10 | 8 |
| 37 | 6 | 310 | 1250 | 1215 | 1050 | 15 | 0.1 | 8 |
| 38 | 6 | 310 | 1270 | 1250 | 1050 | 20 | 0.1 | 10 |
| 39 | 6 | 310 | 1270 | 1235 | 1050 | 20 | 0.1 | 5 |
| 40 | 6 | 310 | 1270 | 1260 | 1050 | 20 | 0.1 | 5 |
| 41 | 6 | 310 | 1270 | 1245 | 1050 | 20 | 0.1 | 10 |
| 42 | 6 | 310 | 1270 | 1240 | 1050 | 20 | 0.1 | 5 |
| 43 | 6 | 310 | 1270 | 1235 | 1050 | 20 | 0.1 | 10 |
| 44 | 6 | 310 | 1270 | 1245 | 1050 | 20 | 0.1 | 10 |

TABLE 2-continued

Table 2

| Sample no. | Hot forging: Width direction working | Hot forging: Die shape ratio | Hot rolling: Reheating temperature (° C.) | Hot rolling: Rolling reduction (%) | Hot rolling: Rolling conditions (*1) | Plate thickness (mm) | Working reduction ratio from slab |
|---|---|---|---|---|---|---|---|
| 1 | Yes | 1.1 | 1150 | 55 | Conforming | 100 | 2.5 |
| 2 | No | 1.1 | 1150 | 39 | Conforming | 130 | 1.9 |
| 3 | No | 1.5 | 1100 | 51 | Conforming | 130 | 2.4 |
| 4 | Yes | 1.5 | 1200 | 45 | Conforming | 210 | 2.1 |
| 5 | Yes | 1.5 | 1130 | 45 | Conforming | 150 | 2.1 |
| 6 | Yes | 1.5 | 1130 | 32 | Conforming | 180 | 1.7 |
| 7 | Yes | 1.5 | 1170 | 20 | Conforming | 210 | 1.5 |
| 8 | No | 1.5 | 1130 | 27 | Conforming | 180 | 1.7 |
| 9 | Yes | 2.5 | 1200 | 42 | Conforming | 240 | 1.9 |
| 10 | No | 1.5 | 1150 | 27 | Conforming | 180 | 1.7 |
| 11 | No | 1.5 | 1150 | 40 | Conforming | 150 | 2.1 |
| 12 | Yes | 2.0 | 1200 | 32 | Conforming | 180 | 1.7 |
| 13 | Yes | 2.0 | 1200 | 45 | Conforming | 150 | 2.1 |
| 14 | No | 1.5 | 1130 | 53 | Conforming | 100 | 2.5 |
| 15 | Yes | 1.5 | 1170 | 45 | Conforming | 150 | 2.1 |
| 16 | Yes | 1.5 | 1200 | 50 | Conforming | 210 | 2.1 |
| 17 | No | 1.5 | 1130 | 40 | Conforming | 150 | 2.1 |
| 18 | Yes | 1.5 | 1170 | 56 | Conforming | 130 | 2.4 |
| 19 | Yes | 1.5 | 1200 | 53 | Conforming | 130 | 2.4 |
| 20 | No | 1.5 | 1130 | 53 | Conforming | 100 | 2.5 |
| 21 | No | 1.5 | 1130 | 50 | Conforming | 100 | 2.5 |
| 22 | No | 1.5 | 1100 | 32 | Conforming | 180 | 1.7 |
| 23 | Yes | 1.1 | 1150 | 58 | Conforming | 100 | 2.5 |
| 24 | Yes | 1.1 | 1150 | 58 | Conforming | 100 | 2.5 |
| 25 | Yes | 1.5 | 1200 | 45 | Conforming | 150 | 2.1 |
| 26 | Yes | 1.5 | 1170 | 45 | Conforming | 150 | 2.1 |
| 27 | Yes | 1.5 | 1200 | 45 | Conforming | 150 | 2.1 |
| 28 | Yes | 1.5 | 1130 | 45 | Conforming | 150 | 2.1 |
| 29 | Yes | 1.5 | 1170 | 45 | Conforming | 150 | 2.1 |
| 30 | Yes | 1.5 | 1200 | 45 | Conforming | 150 | 2.1 |
| 31 | Yes | 1.5 | 1200 | 32 | Conforming | 180 | 1.7 |
| 32 | Yes | 1.5 | 1200 | 32 | Conforming | 180 | 1.7 |
| 33 | No | 1.5 | 1150 | 43 | Conforming | 150 | 2.1 |
| 34 | Yes | 1.5 | 1150 | 48 | Conforming | 150 | 2.1 |
| 35 | No | 1.5 | 1150 | 48 | Conforming | 150 | 2.1 |
| 36 | No | 1.5 | 1100 | 43 | Conforming | 150 | 2.1 |
| 37 | Yes | 1.5 | 800 | 48 | Conforming | 150 | 2.1 |
| 38 | Yes | 1.5 | 1150 | 32 | Conforming | 180 | 1.7 |
| 39 | Yes | 1.5 | 1150 | 32 | Conforming | 180 | 1.7 |
| 40 | Yes | 1.5 | 1100 | 32 | Conforming | 180 | 1.7 |
| 41 | Yes | 1.5 | 1100 | 32 | Conforming | 180 | 1.7 |
| 42 | Yes | 1.5 | 1100 | 32 | Conforming | 180 | 1.7 |
| 43 | No | 1.0 | 1100 | 27 | Conforming | 180 | 1.7 |
| 44 | Yes | 1.5 | 1150 | 32 | Non-conforming | 180 | 1.7 |

(*1) "Conforming" indicates that at least two passes were carried out with a rolling reduction of 4% or more per pass
Underlining indicates deviation from the scope of this disclosure

TABLE 3

Table 3

| Sample no. | Steel no. | Heat treatment conditions of final heat treatment: Reheating temperature (° C.) | Holding time (min) | Cooling end temperature (° C.) | Tempering temperature (° C.) | Tempering time (min) | Base metal properties: YS (MPa) | TS (MPa) | $_{v}E_{-60}$ (J) | Plate thickness direction tension reduction of area (%) | Hardness difference ΔHV (—) | Remarks |
|---|---|---|---|---|---|---|---|---|---|---|---|---|
| 1 | 1 | 1000 | 10 | 150 | 670 | 30 | 517 | 738 | 126 | 60 | 25 | Example |
| 2 | 2 | 900 | 30 | 100 | 670 | 40 | 539 | 653 | 164 | 70 | 21 | Example |
| 3 | 3 | 900 | 30 | 100 | 645 | 90 | 542 | 634 | 155 | 75 | 23 | Example |
| 4 | 4 | 900 | 30 | 100 | 660 | 30 | 535 | 654 | 136 | 65 | 24 | Example |
| 5 | 5 | 900 | 30 | 150 | 645 | 80 | 547 | 670 | 167 | 70 | 25 | Example |
| 6 | 6 | 900 | 30 | 100 | 670 | 40 | 613 | 694 | 168 | 70 | 26 | Example |

TABLE 3-continued

Table 3

| Sample no. | Steel no. | Heat treatment conditions of final heat treatment: Reheating temperature (° C.) | Holding time (min) | Cooling end temperature (° C.) | Tempering temperature (° C.) | Tempering time (min) | Base metal properties: YS (MPa) | TS (MPa) | $_vE_{-60}$ (J) | Plate thickness direction tension reduction of area (%) | Hardness difference ΔHV (—) | Remarks |
|---|---|---|---|---|---|---|---|---|---|---|---|---|
| 7 | 7 | 900 | 30 | 100 | 655 | 50 | 608 | 669 | 154 | 60 | 24 | Example |
| 8 | 8 | 850 | 30 | 100 | 660 | 50 | 567 | 697 | 133 | 60 | 26 | Example |
| 9 | 9 | 900 | 60 | 100 | 660 | 60 | 576 | 657 | 126 | 70 | 27 | Example |
| 10 | 10 | 900 | 30 | 200 | 660 | 50 | 571 | 664 | 146 | 75 | 28 | Example |
| 11 | 11 | 900 | 30 | 100 | 650 | 60 | 556 | 697 | 156 | 60 | 26 | Example |
| 12 | 12 | 900 | 30 | 100 | 660 | 60 | 568 | 664 | 136 | 75 | 24 | Example |
| 13 | 13 | 900 | 30 | 150 | 660 | 60 | 550 | 710 | 135 | 65 | 26 | Example |
| 14 | 14 | 900 | 10 | 100 | 670 | 40 | 572 | 694 | 178 | 65 | 26 | Example |
| 15 | 15 | 900 | 30 | 150 | 670 | 40 | 565 | 633 | 163 | 65 | 25 | Example |
| 16 | 16 | 950 | 60 | 100 | 670 | 30 | 590 | 655 | 145 | 55 | 26 | Example |
| 17 | 17 | 900 | 30 | 150 | 670 | 30 | 525 | 625 | 167 | 55 | 27 | Example |
| 18 | 18 | 900 | 30 | 100 | 650 | 60 | 568 | 663 | 142 | 60 | 21 | Example |
| 19 | 19 | 950 | 30 | 100 | 650 | 60 | 557 | 669 | 146 | 65 | 24 | Example |
| 20 | 20 | 900 | 30 | 150 | 650 | 60 | 552 | 662 | 156 | 60 | 23 | Example |
| 21 | 21 | 900 | 30 | 100 | 650 | 60 | 614 | 684 | 146 | 65 | 21 | Example |
| 22 | 22 | 900 | 30 | 100 | 660 | 50 | 621 | 765 | 37 | 45 | 29 | Comparative Example |
| 23 | 23 | 900 | 30 | 150 | 650 | 60 | 602 | 669 | 36 | 75 | 24 | Comparative Example |
| 24 | 24 | 900 | 10 | 150 | 670 | 30 | 462 | 607 | 36 | 70 | 23 | Comparative Example |
| 25 | 25 | 900 | 30 | 150 | 670 | 30 | 527 | 633 | 35 | 65 | 24 | Comparative Example |
| 26 | 26 | 900 | 30 | 150 | 670 | 30 | 561 | 680 | 25 | 70 | 26 | Comparative Example |
| 27 | 27 | 900 | 30 | 150 | 670 | 30 | 536 | 681 | 26 | 65 | 34 | Comparative Example |
| 28 | 28 | 900 | 30 | 150 | 670 | 30 | 555 | 689 | 24 | 65 | 36 | Comparative Example |
| 29 | 29 | 900 | 30 | 150 | 650 | 60 | 539 | 704 | 25 | 65 | 24 | Comparative Example |
| 30 | 30 | 900 | 30 | 150 | 660 | 60 | 532 | 694 | 32 | 65 | 26 | Comparative Example |
| 31 | 31 | 900 | 30 | 100 | 660 | 50 | 526 | 661 | 33 | 60 | 24 | Comparative Example |
| 32 | 32 | 900 | 30 | 100 | 660 | 60 | 454 | 542 | 45 | 65 | 45 | Comparative Example |
| 33 | 5 | 900 | 30 | 150 | 650 | 60 | 517 | 679 | 105 | 20 | 26 | Comparative Example |
| 34 | 5 | 900 | 30 | 150 | 650 | 60 | 539 | 621 | 88 | 15 | 25 | Comparative Example |
| 35 | 5 | 900 | 30 | 100 | 660 | 50 | 552 | 681 | 83 | 25 | 24 | Comparative Example |
| 36 | 5 | 900 | 30 | 150 | 660 | 50 | 572 | 695 | 91 | 20 | 24 | Comparative Example |
| 37 | 6 | 900 | 30 | 100 | 670 | 30 | 579 | 616 | 22 | 45 | 26 | Comparative Example |
| 38 | 6 | 1100 | 10 | 150 | 650 | 60 | 625 | 722 | 32 | 65 | 24 | Comparative Example |
| 39 | 6 | 750 | 30 | 100 | 650 | 60 | 463 | 533 | 146 | 60 | 20 | Comparative Example |
| 40 | 6 | 900 | 30 | 480 | 650 | 60 | 378 | 576 | 28 | 55 | 24 | Comparative Example |
| 41 | 6 | 900 | 30 | 150 | 730 | 30 | 462 | 560 | 170 | 60 | 26 | Comparative Example |
| 42 | 6 | 900 | 30 | 150 | 400 | 60 | 596 | 759 | 65 | 55 | 35 | Comparative Example |
| 43 | 6 | 900 | 30 | 150 | 650 | 60 | 537 | 702 | 175 | 25 | 26 | Comparative Example |
| 44 | 6 | 900 | 30 | 150 | 660 | 60 | 512 | 636 | 26 | 45 | 28 | Comparative Example |

Underlining indicates deviation from the scope of this disclosure

It can be seen from Table 3 that for each steel plate obtained in accordance with this disclosure (samples 1-21), YS was 500 MPa or more, TS was 610 MPa or more, base metal toughness ($_vE_{-60}$) was 70 J or more, reduction of area in the plate thickness direction tensile test was 40% or more, and the hardness difference ΔHV was 30 or less. Accordingly, each of these steel plates had excellent base metal strength, toughness, plate thickness direction tensile properties, and material homogeneity.

In contrast, it can be seen that at least one of these properties was poor in each of samples 22-44 having a chemical composition or production conditions outside of the suitable ranges.

REFERENCE SIGNS LIST

1 upper die

2 lower die

3 slab

The invention claimed is:

1. A thick steel plate having a plate thickness of 100 mm or more, having a chemical composition containing, in mass %, C: 0.08% to 0.20%,
Si: 0.40% or less,
Mn: 0.5% to 5.0%,
P: 0.015% or less,
S: 0.0050% or less,
Ni: 5.0% or less,
Ti: 0.005% to 0.020%,
Al: 0.080% or less,
N: 0.0070% or less,
B: 0.0030% or less, and
one or more selected from
Cu: 0.50% or less,
Cr: 3.0% or less,
Mo: 1.50% or less,
V: 0.200% or less, and
Nb: 0.100% or less,
the balance being Fe and incidental impurities, wherein a value $Ceq^{IIW}$ defined by formula (1) below is 0.55 to 0.80:

$$Ceq^{IIW}=C+Mn/6+(Cu+Ni)/15+(Cr+Mo+V)/5 \quad (1)$$

where each element symbol indicates content, in mass %, of a corresponding element in the chemical composition and is taken to be 0 when the corresponding element is not contained, a mid-thickness part of the steel plate has a yield strength of 500 MPa or more, reduction of area in the mid-thickness part by tension in a plate thickness direction is 40% or more, and the mid-thickness part has a low-temperature toughness at −60° C. of 70 J or more.

2. The thick steel plate of claim 1, wherein the chemical composition further contains, in mass %, one or more selected from Mg: 0.0005% to 0.0100%, Ta: 0.01% to 0.20%, Zr: 0.005% to 0.1%, Y: 0.001% to 0.01%, Ca: 0.0005% to 0.0050%, and REM: 0.0005% to 0.0200%.

3. The thick steel plate of claim 2, wherein in a hardness distribution in the plate thickness direction, a difference ΔHV between average hardness of a plate thickness surface (HVS) and average hardness of the mid-thickness part (HVC), where ΔHV =HVS −HVC, is 30 or less.

4. The thick steel plate of claim 1, wherein in a hardness distribution in the plate thickness direction, a difference ΔHV between average hardness of a plate thickness surface (HVS) and average hardness of the mid-thickness part (HVC), where ΔHV=HVS−HVC, is 30 or less.

5. A method for producing the thick steel plate of claim 1, comprising heating a continuously-cast slab having the chemical composition containing, in mass %, C: 0.08% to 0.20%, Si: 0.40% or less, Mn: 0.5% to 5.0%, P: 0.015% or less, S: 0.0050% or less, Ni: 5.0% or less, Ti: 0.005% to 0.020%, Al: 0.080% or less, N: 0.0070% or less, B: 0.0030% or less, and one or more selected from Cu: 0.50% or less, Cr: 3.0% or less, Mo: 1.50% or less, V: 0.200% or less, and Nb: 0.100% or less, the balance being Fe and incidental impurities, to at least 1200° C. and no higher than 1350° C., then hot forging the continuously-cast slab under conditions of a temperature of 1000° C. or higher, a strain rate of 3/s or less, and a cumulative working reduction of 15% or more using opposing dies having respective short sides differing such that when a short side length of a die having a shorter one of the short sides is taken to be 1, a short side length of a die having a longer one of the short sides is 1.1 to 3.0, then allowing cooling to obtain a steel raw material, then reheating the steel raw material to at least an $Ac_3$ temperature and no higher than 1250° C., then performing hot rolling of the steel raw material including at least two passes carried out with a rolling reduction of 4% or more per pass, then allowing cooling to obtain a thick steel plate, then reheating the thick steel plate to at least the $Ac_3$ temperature and no higher than 1050° C., then rapidly cooling the thick steel plate to 350° C. or lower, and then tempering the thick steel plate at at least 550° C. and no higher 700° C.

6. The method of claim 5, wherein a working reduction ratio from the continuously-cast slab prior to working to the thick steel plate obtained after the hot rolling in production of the high toughness and high tensile strength thick steel plate is 3 or less.

7. The method of claim 5, wherein the chemical composition further contains, in mass %, one or more selected from Mg: 0.0005% to 0.0100%, Ta: 0.01% to 0.20%, Zr: 0.005% to 0.1%, Y: 0.001% to 0.01%, Ca: 0.0005% to 0.0050%, and REM: 0.0005% to 0.0200%.

8. The method of claim 7, wherein a working reduction ratio from the continuously-cast slab prior to working to the thick steel plate obtained after the hot rolling in production of the high toughness and high tensile strength thick steel plate is 3 or less.

9. The method of claim 5, wherein in a hardness distribution in the plate thickness direction, a difference ΔHV between average hardness of a plate thickness surface (HVS) and average hardness of the mid-thickness part (HVC), where ΔHV =HVS −HVC, is 30 or less.

10. The method of claim 9, wherein a working reduction ratio from the continuously-cast slab prior to working to the thick steel plate obtained after the hot rolling in production of the high toughness and high tensile strength thick steel plate is 3 or less.

* * * * *